US009642448B2

(12) United States Patent
Lhoyer

(10) Patent No.: US 9,642,448 B2
(45) Date of Patent: May 9, 2017

(54) COSMETIC PRODUCT APPLICATOR

(75) Inventor: Patrick Lhoyer, Mouy (FR)

(73) Assignee: Albea Services, Gennevilliers (FR)

( * ) Notice: Subject to any disclaimer, the term of this patent is extended or adjusted under 35 U.S.C. 154(b) by 1202 days.

(21) Appl. No.: 12/514,473

(22) PCT Filed: Mar. 6, 2007

(86) PCT No.: PCT/FR2007/000392

§ 371 (c)(1),
(2), (4) Date: May 12, 2009

(87) PCT Pub. No.: WO2008/065260

PCT Pub. Date: Jun. 5, 2008

(65) Prior Publication Data

US 2010/0051045 A1 Mar. 4, 2010

Related U.S. Application Data

(60) Provisional application No. 60/868,230, filed on Dec. 1, 2006.

(51) Int. Cl.
*A46B 3/18* (2006.01)

(52) U.S. Cl.
CPC ..... *A46B 3/18* (2013.01); *A46B 2200/1053* (2013.01)

(58) Field of Classification Search
USPC ..... 132/218, 320, 317; 15/206; 300/21
See application file for complete search history.

(56) References Cited

U.S. PATENT DOCUMENTS 5,609,398 A * 3/1997 Warner et al. ..... 300/21
7,089,946 B2 * 8/2006 Rousselet ..... 132/218

FOREIGN PATENT DOCUMENTS

EP 0467126 A1 1/1992
GB 827929 A 2/1960
GB 2085718 A 5/1982

OTHER PUBLICATIONS

International Search Report Issued Jul. 27, 2007 for PCT/FR2007/000392 (WO 2008/065260 A1).

* cited by examiner

*Primary Examiner* — Rachel Steitz
(74) *Attorney, Agent, or Firm* — Banner & Witcoff, Ltd.

(57) ABSTRACT

An applicator for cosmetic products, typically mascara, comprising a brush made up of fibers trapped between two twisted arms extending in an axial direction and defining turns is characterized in that at least one of said turns is a turn that is not circular. More particularly, these turns describe noncircular ellipses. Such an applicator can be obtained by radial crushing of a standard type brush.

13 Claims, 8 Drawing Sheets

COSMETIC PRODUCT APPLICATOR

CROSS REFERENCE TO RELATED APPLICATIONS

This application is a National Stage application of co-pending PCT application PCT/FR2007/000392 filed Mar. 6, 2007, which claims the benefit of U.S. Provisional Application No. 60/868,230 filed Dec. 1, 2006. These applications are incorporated herein by reference in their entireties.

FIELD OF THE INVENTION

The invention relates to the field of applicators for fluid or pasty products, particularly onto keratinous fibers, typically applicators of cosmetic products such as mascaras.

BACKGROUND OF RELATED ART

A large number of mascara applicators are already known.

These applicators, designed to work in conjunction with a container forming a tank for the mascara, typically include:

a) a cap designed to seal said container and to be used as means of gripping said applicator, b) an axial rod, c) and a means of application.

Said means of application or applicator may be made up of a brush, said rod being interdependent of said cap at one of its ends, and of said brush at the other of its ends, said brush including a metal twist uniting a plurality of bristles or fibers.

With regard to said brush, very many brush methods are already known. The brushes described in the documents of French patent FR 2 505 633, FR 2 605 505, FR 2 607 372, FR 2 607 373, FR 2 627 068, FR 2 627 363, FR 2 637 471, FR 2 637 472, FR 2 650 162, FR 2 663 826, FR 2 668 905, FR 2 675 355, FR 2 685 859, FR 2 690 318, FR 2 701 198, FR 2 706 749, FR 2 715 038, FR 2 745 481, FR 2 748 913, FR 2 749 489, FR 2 749 490, FR 2 753 614, FR 2 755 693, FR 2 774 269, FR 2 796 531, FR 2 796 532, FR 2 800 586 are known.

The brushes described in U.S. Pat. No. 4,733,425, U.S. Pat. No. 4,861,179, U.S. Pat. No. 5,357,987, U.S. Pat. No. 5,595,198, U.S. Pat. No. 6,241,411, U.S. Pat. No. 6,427,700 are also known.

In the following, "standard type brush" will be taken to mean a conventional brush obtained by trapping fibers in a wire folded onto itself and twisted, also known as a "twist in wire brush".

Problems Posed

On the one hand, in view of the permanent changes that mascara formulas undergo, there is a need for developing new applicators to allow these formulas to be applied, and typically adapted to each new formula.

For users, there is also a need for a large range of applicators to obtain different effects, for example loading the applicator to differing degrees with the product to be applied and/or various effects obtained by combing the lashes.

In addition it is increasingly necessary to integrate new technical functions into the applicators, both to meet with users' needs, and also to differentiate from "bottom-of-the-range" products that can be produced in low-cost countries.

Finally, in the field of cosmetic products, there is a permanent demand for new products, particularly in order to personalize the products, whether in terms of formulas, applicators or their packaging in general, so much so that product renewal is becoming an absolute commercial necessity, if one does not wish to see the product disappear from the market.

Mascara users have a preference for mascara applicators including a large sized brush. Such brushes advantageously have a large combing capacity but in contrast they also have a low capacity for becoming loaded with mascara to create volume. Consequently, brushes with an increased mascara loading capacity are sought after.

It is current practice to modify the number of fibers per turn of the brush, or the length, shape, hardness, diameter, etc. of the fibers to obtain the required loading capacity.

For example U.S. Pat. No. 4,927,281 discloses a brush comprising fibers provided with grooves, or patent document EP 1 459 647 which discloses a brush with bent bristles that do not extend radially. The gains in loading capacity are very limited and the fibers expensive, because of their special nature.

The documents of patent EP 1 518 477 and U.S. Pat. No. 4,586,520 propose brushes with an axial alternation of portions with long fibers and portions with short fibers, the portions of short fibers acting as mascara tanks and the portions of long fibers acting as combs. Obvious problems prevent such brushes from being manufactured because of the difficulty of obtaining, by automated means, this axial alternation of long and short fibers prior to winding the metal twist.

Patent documents FR 2 793 121, WO 2001 41.599, U.S. Pat. No. 5,595,198, U.S. Pat. No. 5,551,456, EP 0 925 741, etc. also disclose applicator brushes for mascara including cavities formed by the ablation of portions of fibers of standard type brushes, said cavities making it possible to retain a significant amount of mascara with a view to applying it in a single application. This ablation operation, for example by trimming or laser cutting, is complex to set up, involves a reduction in the combing capacity of the brush because of the reduction in the number of bristles, and weakens the resistance of the remaining bristles, leading to a shortening of the lifespan of the applicator.

The first goal of the invention was consequently to propose another applicator of the brush type making it possible to apply a significant amount of mascara in a single application so as to impart volume to the lashes.

Another goal of the invention is to propose such an applicator which can be obtained from a brush of the standard type without ablating any fibers.

Still another goal of the invention is to propose a process for the manufacture of an applicator for applying a significant amount of mascara which is at the same time simple, inexpensive, quick and reliable. Such a process shall more particularly make it possible to obtain such an applicator without ablation of fibers from a standard type brush.

DESCRIPTION OF THE INVENTION

For this purpose, the aim of the invention is a cosmetic product applicator comprising fibers trapped between two twisted arms extending in an axial direction and defining turns, characterized in that at least one of said turns is a turn that is not circular.

The fibers are laid out so as to allow the brush to retain a significant amount of mascara. In fact, such a brush has cavities with no fibers because of the shape of the twisted arms. According to various preferred embodiments of the invention, the applicator may also include the following characteristics:

- the turns are not circular on at least one axial portion of the applicator;
- the turn(s) that is/are not circular describe(s) noncircular ellipses;
- said noncircular ellipses have a ratio of large axis to small axis that is greater than 1.1;
- the noncircular turns are formed by crushing circular turns.

The invention also covers a device for conditioning and application a product designed to be applied to the lashes or the eyebrows, including a container containing the product to be applied and comprising an applicator such as defined above.

The invention also covers a manufacturing process for a brush, characterized in that it includes stages consisting in:

- taking a brush comprising bristles trapped between two twisted arms extending in an axial direction; and
- applying a radial pressure to said twisted arms.

The radial pressure is preferably applied by tightening said twisted arms between n jaws of a press, n ranging between 2 and 6.

The jaws are preferably stopped at the end of their travel by a calibration gauge.

The invention will be better understood by means of the following description and the appended figures given as nonrestrictive examples.

DETAILED DESCRIPTION OF THE INVENTION

In order to facilitate understanding of the invention and to avoid any mistakes in interpretation, we will frequently draw a parallel between a standard type brush, well-known in the field, and a brush according to the invention.

Figure 1:
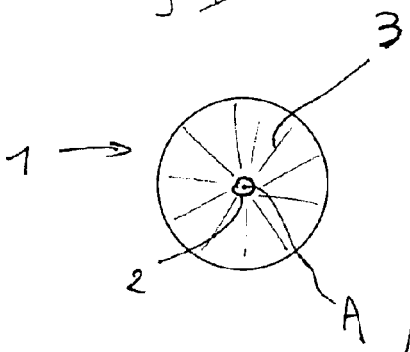
FIG. 1 is a schematic view from below of a standard type brush.
Figure 2:
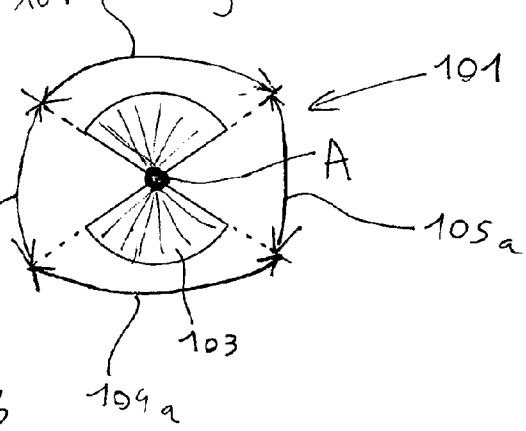
FIG. 2 is a schematic view from below of a brush according to the invention.

FIGS. 1 and 2 show a standard type brush 1 and a brush 101 according to the invention respectively, from below.

Standard brush 1 consists of a twisted wire 2 imprisoning fibers 3. As can be seen in FIG. 1, the fibers of such a standard brush 1 are regularly distributed all around a central axis A (also known as the axial direction). More particularly, the fibers are rolled as a helix around this said axis A.

As can be seen in FIG. 2, brush 101 according to the invention comprises a distribution of fibers 103 making up the brush around a central axis A which is different from standard brush 1 and recalling known brushes, for example FR 2 791 121 obtained from a standard type brush by ablation of fibers on one or more angular sectors around the central axis. Fibers 103 of brush 101 are not regularly distributed all around axis A. More particularly, fibers 103 of brush 101 are distributed over two angular portions 104*a*, 104*b* around axis A, these angular portions 104*a*, 104*b* being separated by angular portions 105*a*, 105*b* that have no fibers. Advantageously, the angular portions 105*a*, 105*b* with no fibers constitute cavities that can become gorged with mascara.

Brush 101 according to the invention derives more particularly from a deformation of a standard type brush, and more particularly from a deformation of the twisted arms or core, so as to reorganize the way the fibers are laid out. This reorganization does not lead to the ablation of fibers.

Such a brush 101 according to the invention can be obtained by using the process according to the invention described hereafter.

Figure 3:
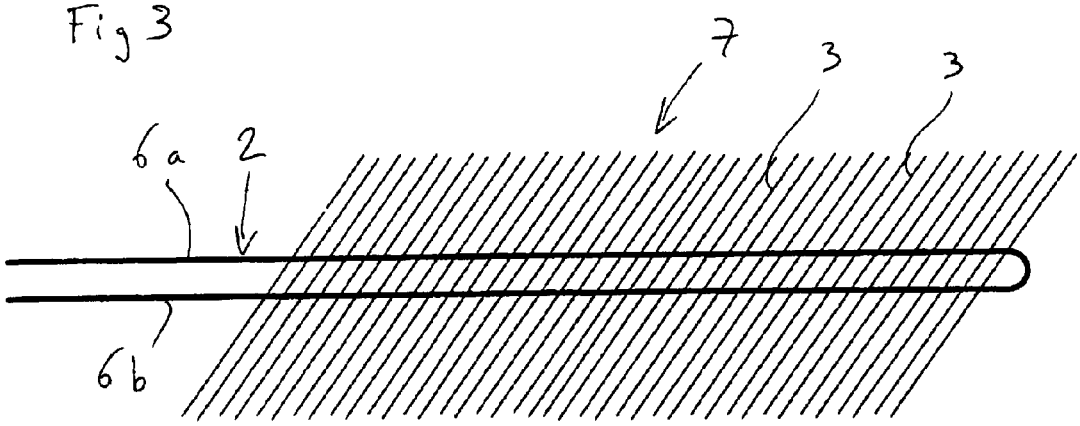
FIG. 3 schematically shows a layer of fibers placed between two arms of a wire.
Figure 4:
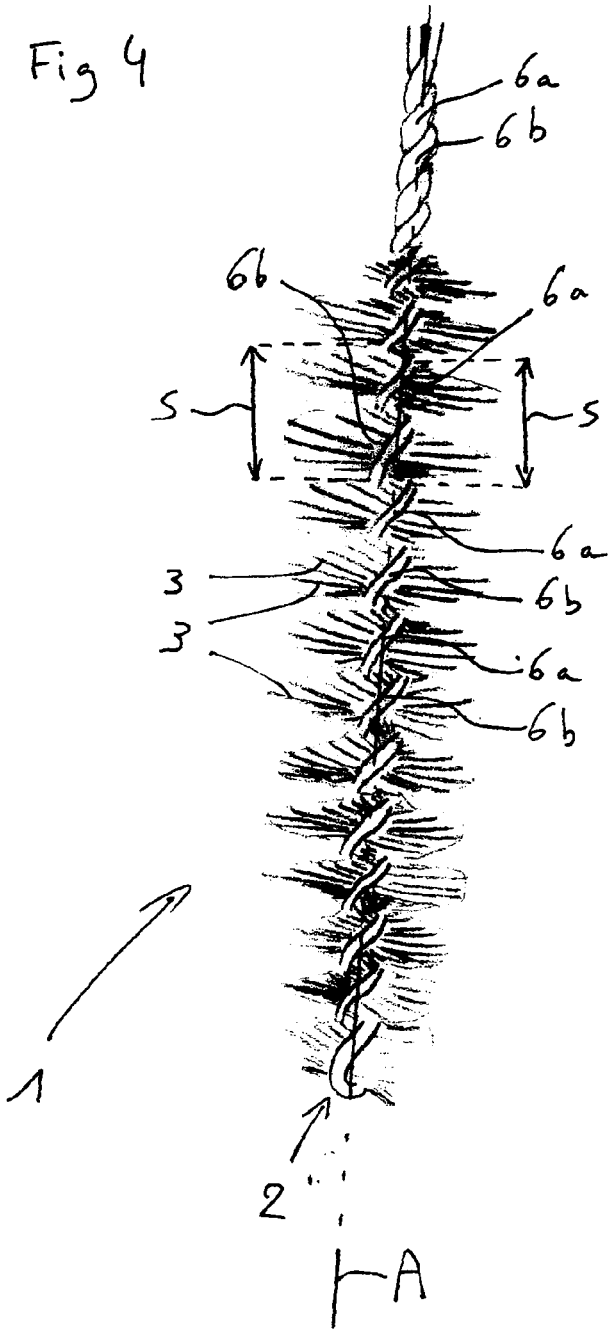
FIG. 4 is an enlarged front view of a standard type brush.

First, one procures a device for manufacturing brushes with a deformable wire, more particularly a standard metal wire of circular section, and with fibers, for example made of polyamide or other synthetic or natural, hollow or solid materials, or a mixture of these fibers. The manufacturing device is typically a so-called standard device including means for cutting out a portion of said wire, folding said portion of wire 2 to form a U-shaped pin with two substantially parallel arms 6*a*, 6*b* and placing between said arms 6*a*, 6*b* a regular layer 7 of fibers 3, as can be seen in FIG. 3. The pin more particularly forms a perpendicular bisector of layer 7. The manufacturing device also comprises a means for twisting the arms of the pin between which the fibers are trapped. In this way, a standard type brush 1 as shown in FIG. 4 is obtained. The twisted arms 6*a*, 6*b* each describe circulars turns, and fibers 3, caught and held between two adjacent turns of arms 6*a*, 6*b*, form a double continuous helical winding, the twisted arms and the helical winding of fibers extending in the same axial direction A.

Figure 5:
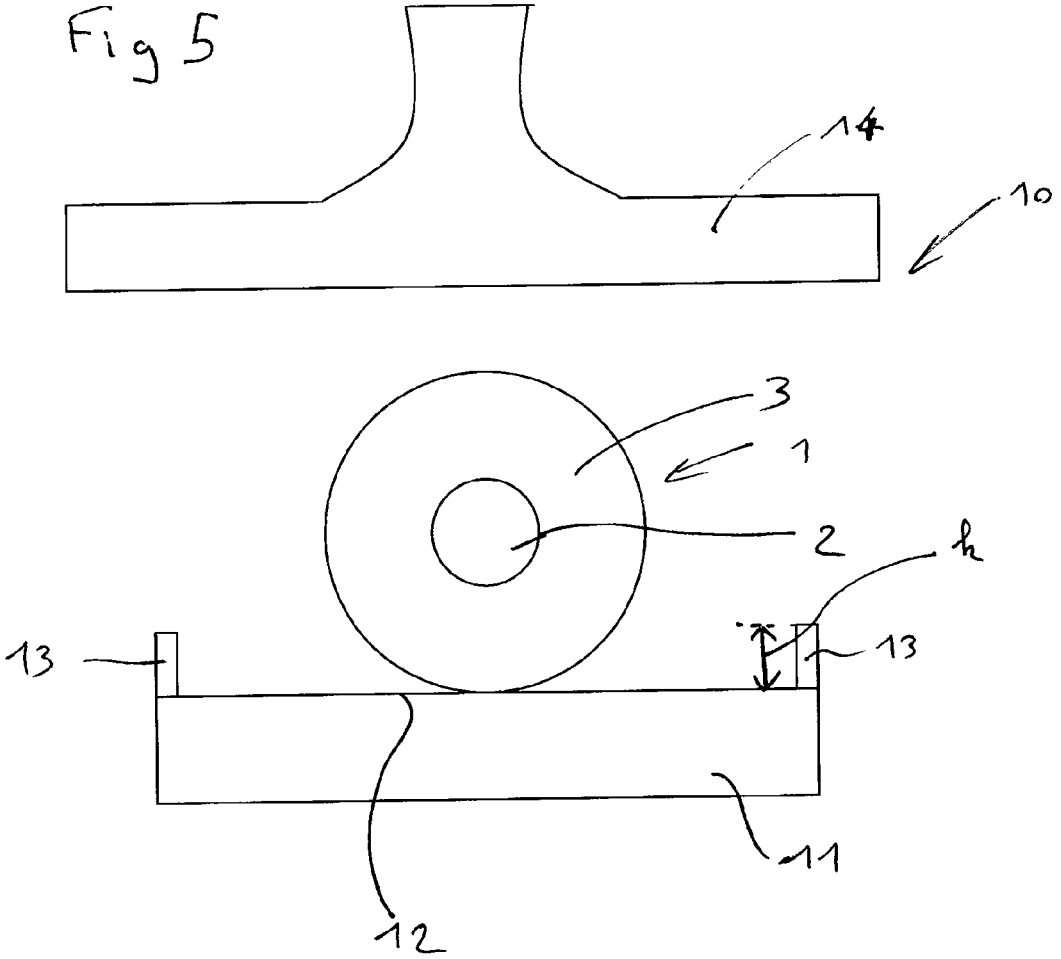
FIG. 5 illustrates schematically a press at rest ready to crush a brush.
Figure 6:
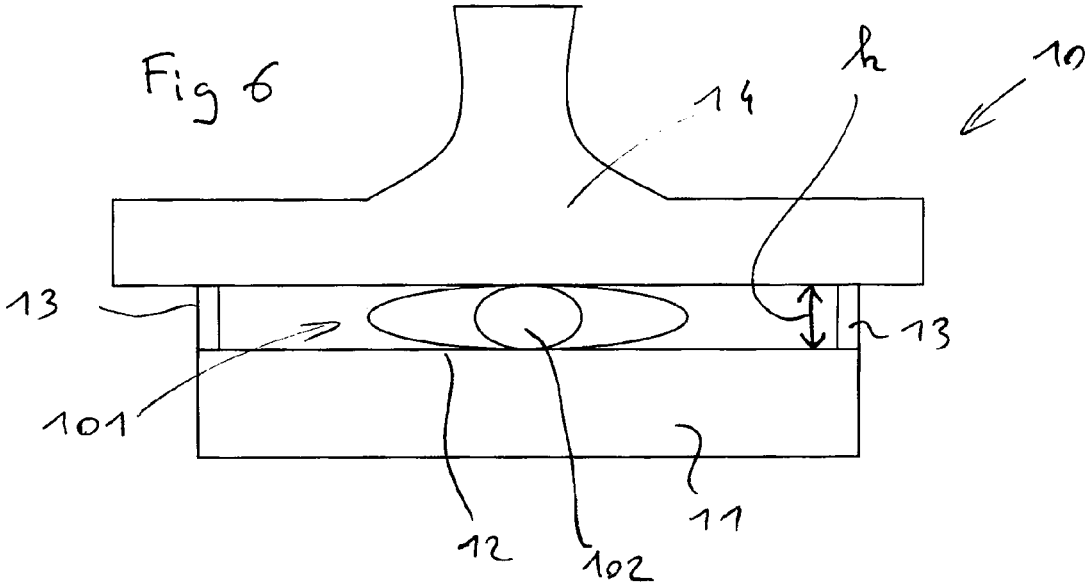
FIG. 6 illustrates the press in FIG. 5 under compression.
Figure 7A:
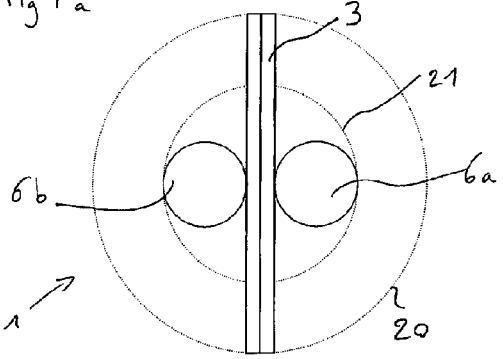
FIGS. 7*a*, 7*b*, 7*c* are radial cross-section views of a standard type brush.
Figure 8A:
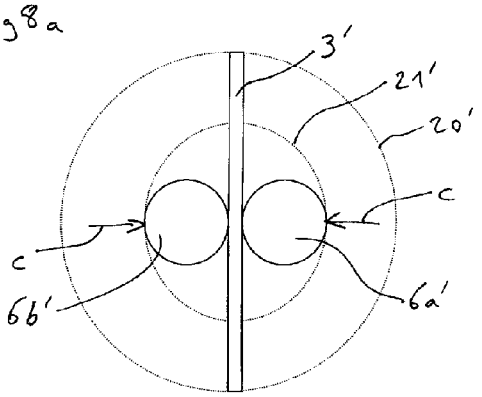
FIGS. 8*a*, 8*b*, 8*c* are radial cross-section views of a very slightly crushed brush.
Figure 7B:
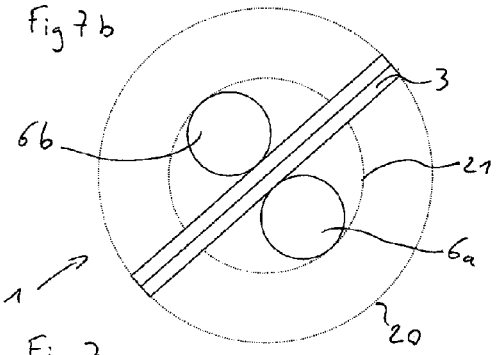
Figure 8B:
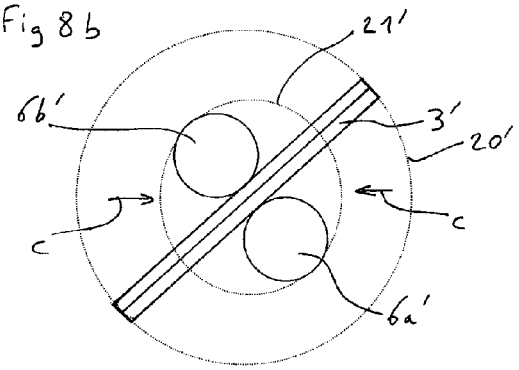
Figure 7C:
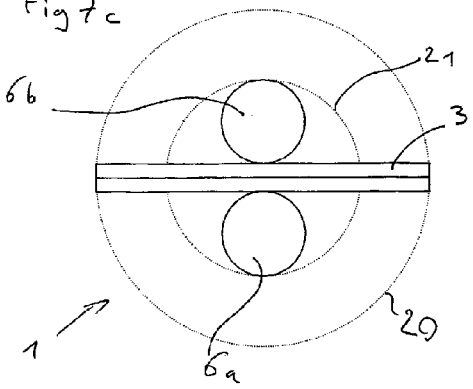
Figure 8C:
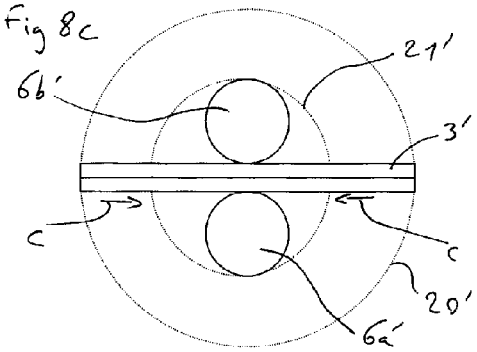
Figure 9A:
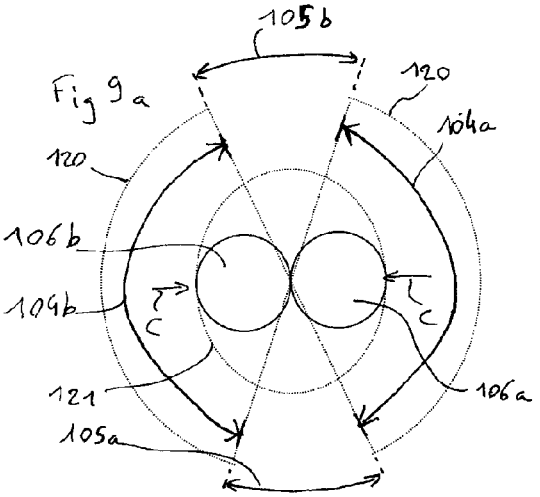
FIGS. 9*a*, 9*b*, 9*c* are radial cross-section views of a moderately crushed brush.
Figure 10A:
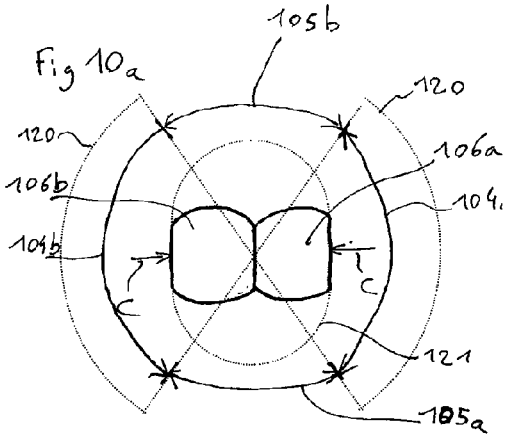
FIGS. 10*a*, 10*b*, 10*c* are radial cross-section views of a highly crushed brush.
Figure 9B:
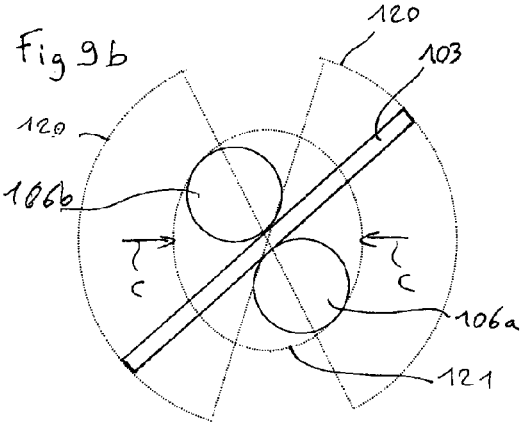
Figure 10B:
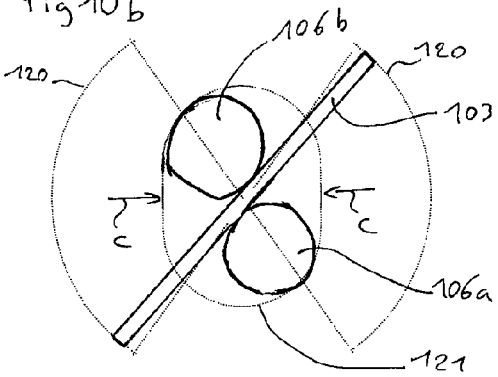
Figure 9C:
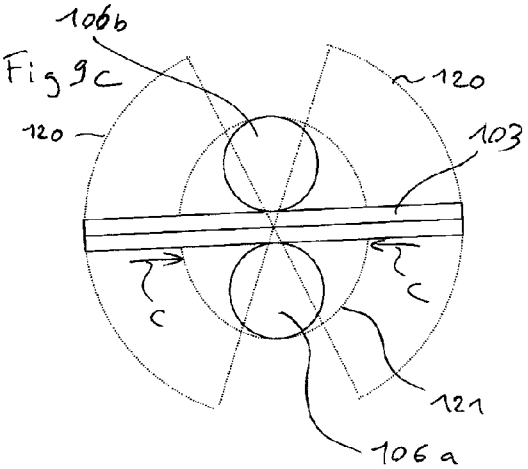
Figure 10C:
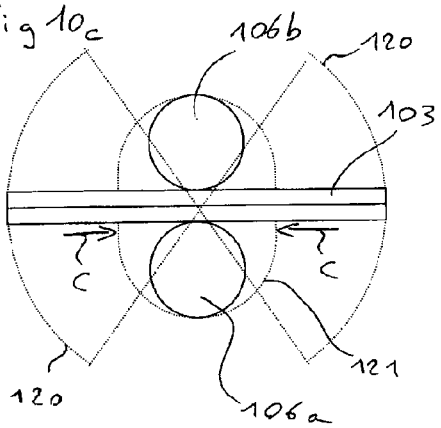

The standard type brush 1 formed in this way is then inserted between the jaws of a press, and then compressed. FIGS. 5 and 6 show, by way of example, a press 10 at rest and under compression respectively. Press 10 comprises an anvil 11 provided with a crushing surface 12 and calibration gauges 13 of height h, and a striker 14. The standard type brush 1 is laid out flat on the crushing surface 12 between the calibration gauges 13. Wire 2 of brush 1 is shown schematically by a circle illustrating the circular winding of the arms of wire 2. The striker 14 is then lowered, deflects fibers 3 and deforms and crushes the arms of wire 2 until it comes up against the calibration gauges 13, as shown in FIG. 6. This then gives brush 101 according to the invention, by deformation of standard type brush 1. The arms of wire 102 of brush 101 according to the invention are wound into turns describing ellipses.

When brush 101 is withdrawn from press 10, it can be seen that it has two angular sectors extending in the axial direction without fibers on either side of wire 102.

We will now give a theoretical explanation of the principle of reorganization of the fibers by crushing the brush.

For this purpose we will refer to FIGS. 7*a-c*, 8*a-c*, 9*a-c* and 10*a-c* which illustrate various degrees of crushing of a brush, i.e. a standard brush 1, an intermediate brush 1', and two brushes 101 according to the invention respectively. Figures Xa, Xb, Xc show cross-sections at various levels in the axial direction on a quarter of a turn. Each of these figures shows, as dotted lines, an orthogonal projection 20, 20', 120 of the fibers 3, 3', 103 of brush 1, 1', 101 in the axial direction and an orthogonal projection 21, 21', 121 of the profiles of arms 6*a*, 6*b*, 6*a'*, 6*b'*, 106*a*, 106*b* of the brush in the axial direction which more specifically shows the shape of the turns of the arms of the brush. Compression or crushing is carried out radially in the direction indicated by the arrows c.

It can be observed that the orthogonal projections 20, 21 of fibers 3, of arms 6*a*, 6*b* respectively of standard type brush 1 are circular, this brush 1 being manufactured by regular circular winding or regular circular twisting of the arms and forming a double helical winding of fibers.

Orthogonal projections 120, 121 of fibers 103 of brushes 101 according to the invention, i.e. after crushing, show the formation of angular portions 104*a*, 104*b* with fibers and angular portions 105*a*, 105*b* without fibers. The relative sizes of these portions 104/105 depend on the crushing applied. The more arms 106*a*, 106*b* are crushed, the wider the angular space 105*a*, 105*b* without fibers.

The orthogonal projections 21, 21', 121 of the profiles of the brush arms change because of the compression applied. The wire remains substantially in its crushed form after crushing in the press. The turns of the brush become bent by crushing, from a circular trajectory until they describe an increasingly extended elliptic or ovoid trajectory as compression intensifies.

In a brush 1 of standard type, the fibers are inserted regularly between the twisted arms so that two adjacent arms are slightly distant. Because of the compression, the distance between the adjacent arms in the direction of compression decreases until it becomes null on one portion of turns. The fibers caught between the arms where this distance decreases slip between the arms along the turn so that the fibers that beforehand were laid out regularly on 360° between two adjacent turns now find themselves trapped on a restricted portion of these adjacent turns wherever the arm-to-arm distance is sufficient.

Consequently, the form of the twisted core and the organization of the fibers are modified by crushing. As the fibers extend substantially radially, perpendicular to the direction between the arms holding them, the angular portions 104*a*, 104*b* with fibers are on the sides where compression was exerted.

In the brush according to the invention, the twisted arms define turns which are not circular, unlike standard type brushes. These turns are more particularly elliptic or ovoid (not circular), as in the case where the brush according to the invention is obtained by compression between two jaws of a press. In this way, between two adjacent turns, angular portions are deprived of fibers.

In other words, the orthogonal projection of the profile of the arms in a plane normal to the axial direction describes a noncircular ellipse.

According to the invention, the elliptical turns preferably have a ratio of large axis to small axis greater than 1.1 and even more preferably ranging between 1.3 and 1.6.

Figure 11:
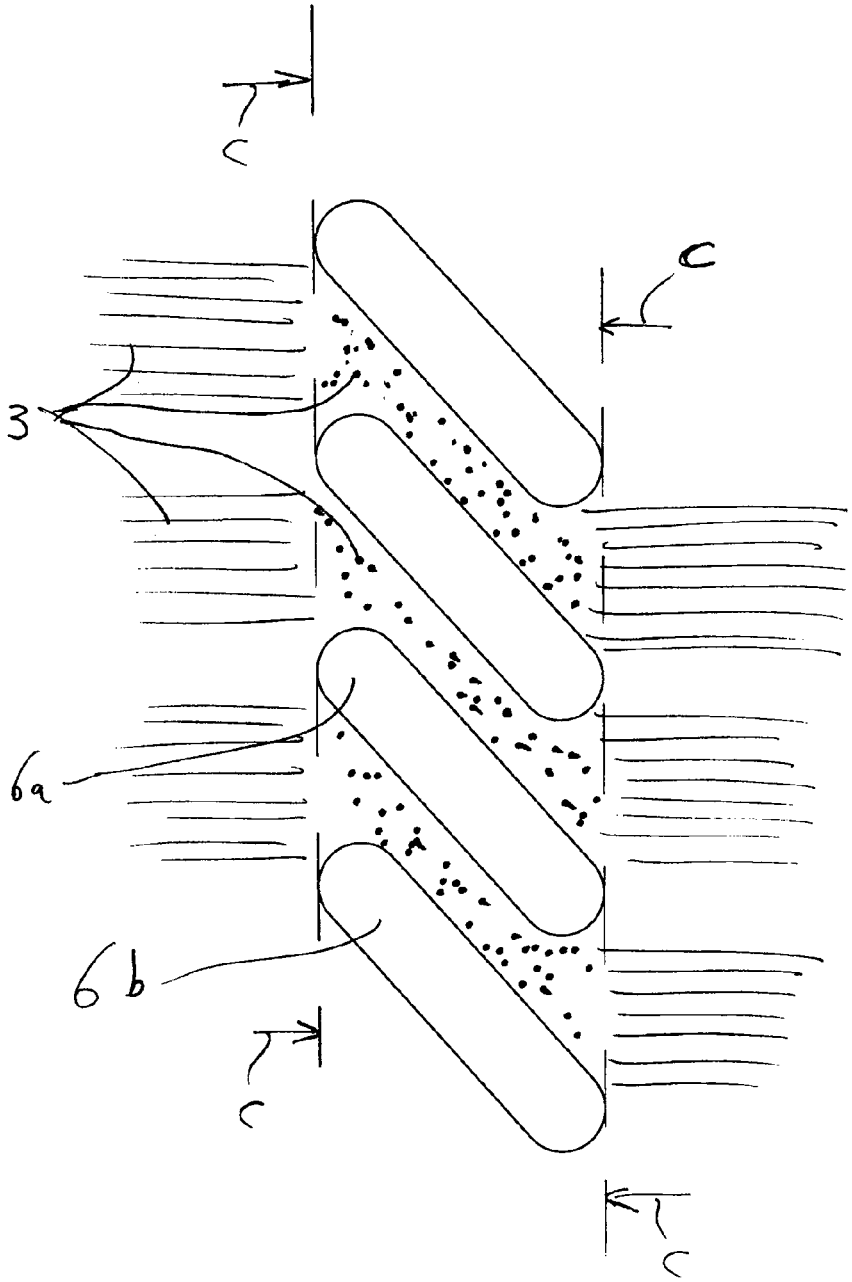
FIG. 11 is a schematic front view of a standard type brush.
Figure 12:
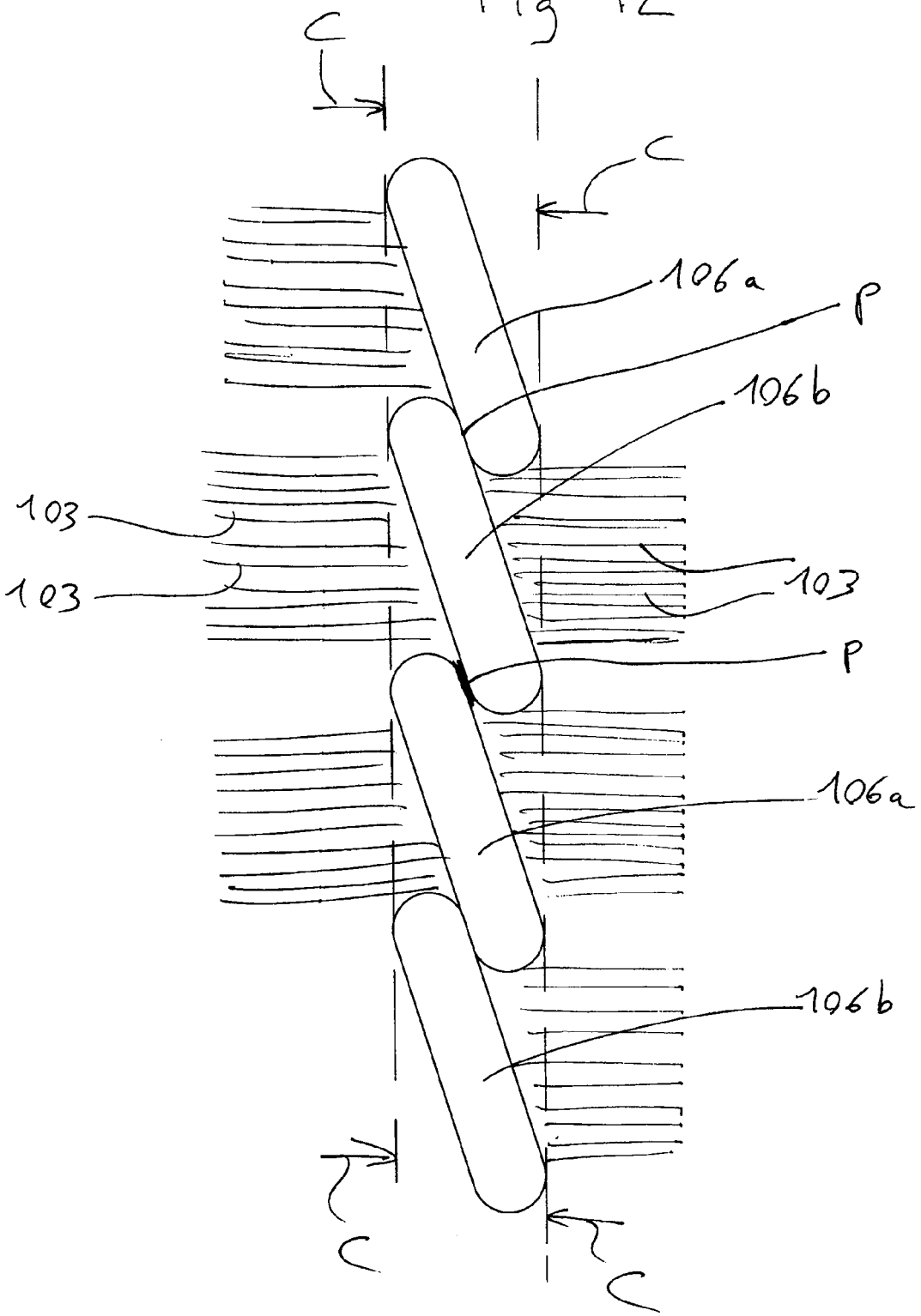
FIG. 12 is a schematic front view of a brush according to the invention along the compression plane.

The deformations caused by crushing are also illustrated from another angle in FIGS. 11 and 12 which show a standard type brush 1 and a brush according to the invention 101 respectively, in the compression plane. Compression c has brought into contact arms 106*a*, 106*b* on two adjacent turns on a portion of turn p on the sides where compression has not been exerted. Fibers 103 have been driven out on either side of this portion of turn p. Arms 106*a*, 106*b* have a greater axial orientation on the side where compression has not been exerted than on the other. The pitch of each turn increases slightly.

Figure 13:
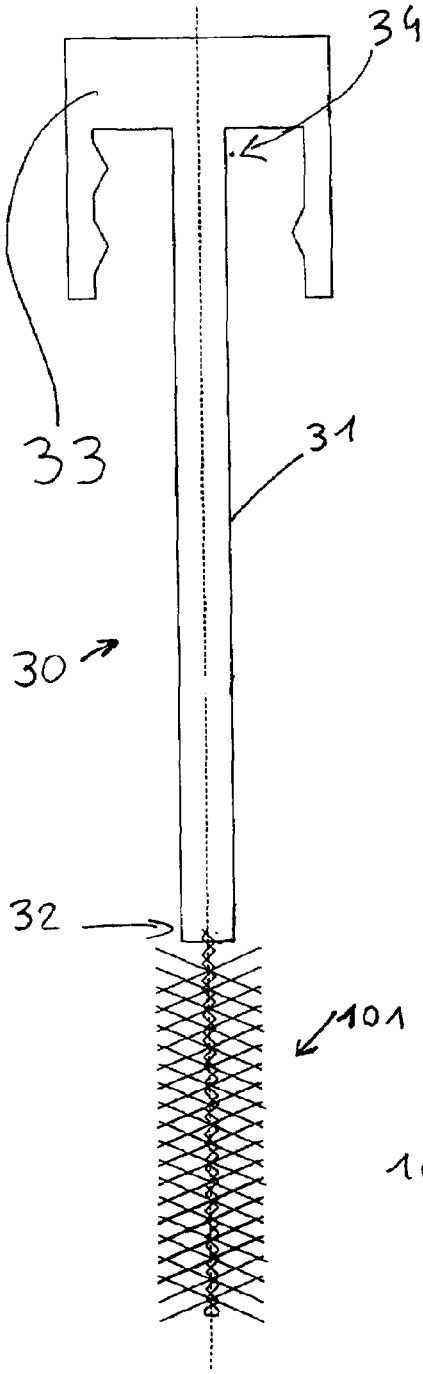
FIG. 13 is a schematic view of an applicator according to the invention.

FIG. 13 schematically represents an applicator 30 including a brush 101 according to the invention, an axial rod 31 interdependent at an end 32 said to be lower than said brush, typically via a free axial end of said brush 101, and a means of gripping 33 interdependent of said axial rod 31 at an end 34 said to be higher.

Figure 14:
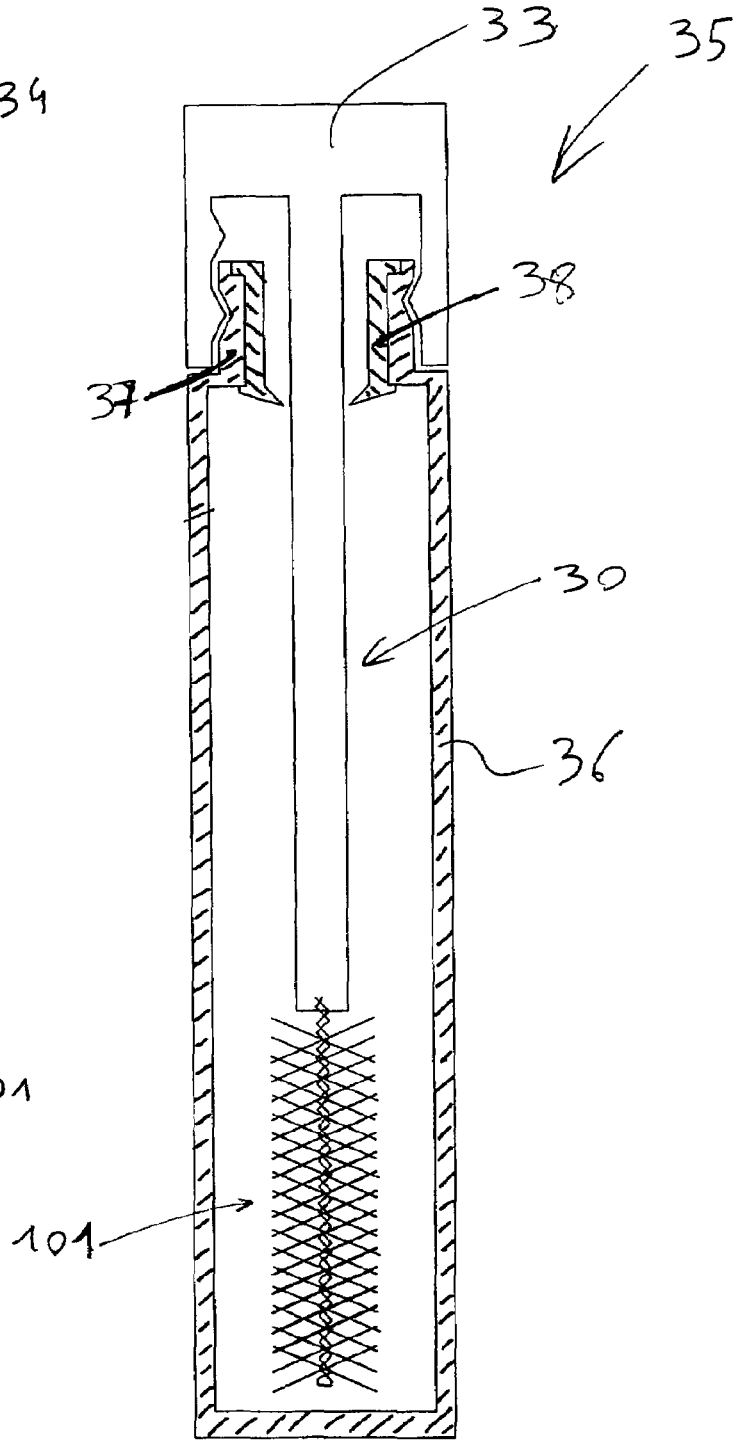
FIG. 14 is a schematic view of a dispenser-applicator according to the invention.

FIG. 14 represents a dispenser-applicator 35 according to the invention, including a mascara tank 36 equipped with a threaded neck 37 which works in conjunction with said means of gripping 33 forming a cap, and a wiper 38 interdependent of said neck 37.

When the applicator is screwed onto the dispenser, the fibers are immersed in the mascara. At this point, brush 1 is too heavily loaded with mascara. Withdrawing it the tank forces the fibers through the middle of the lips of the wiper which takes off the surplus product and removes product from the ends of the fibers so as to make them able to apply and comb. Brush 101 according to the invention can take on product in the angular portions 105*a*, 105*b* that have no fibers so that said brush according to the invention has a high loading capacity and makes it possible to obtain a large volume at each application.

Example of Embodiment

A brush according to the invention is produced with the following technical characteristics:

hollow fibers of 4 mm in diameter and 8.5 mm in length.
50 fibers per turn
a stainless steel 304L wire, 0.7 mm in diameter
13 turns for 27 mm of tuft
a crushing dimension of 1.1 mm.

To obtain such a brush, a standard type brush is manufactured having the first 4 characteristics mentioned above. This brush is placed in a press between calibration gauges of 1.1 mm height and said brush is crushed until the press arrives at the end of its travel up against the calibration gauges. The brush formed in this way comprises two symmetrical grooves in relation to the central axis of the brush, said grooves extending in the axial direction and each having an angular sector with no fibers of approximately 90°. The turns of this brush are elliptical and have a large axis (~1.6) to small axis (1.1) ratio of approximately 1.45. Such a brush has a high loading capacity and can be used with any type of mascara formula.

It is obviously possible to use any type of press to manufacture the brush according to the invention. A simple smooth jaw vise is perfectly suitable.

The use of calibration gauges makes it possible to obtain perfect reproducibility of the crushing applied to a standard type brush and consequently perfect reproducibility of the opening angle of the angular portions that have no fibers. To modify this opening angle, all that is required is to modify the height h of the calibration gauges.

Reproducible crushing of the brushes between the jaws of the press can also be obtained by measuring and checking the pressure applied between the jaws.

Preferably, crushing is carried out progressively, so as to allow the fibers to slip between the arms.

It should also be noted that it is possible to trim or grind the brush, before or after crushing so as to obtain a desired external global envelope of fibers, for example perfectly cylindrical, convex, conical, etc.

Treatment by crushing can, in addition, be carried out on only one or several sections of the length of the brush. The brush then has alternating normal portions and portions with cavities. It is also possible to perform crushing in a first direction on part of the brush and in a second direction perpendicular to said first direction on another part of the brush.

According to a variant, a brush according to the invention can also be manufactured by compression in a press comprising n jaws, these jaws simultaneously compressing the brush radially. This then gives a brush comprising n grooves without fibers extending axially and distributed around the axis. The number n of jaws is preferably lower than 6. With 4 jaws compressing the brush at right angles two by two, one obtains a brush with 4 axial grooves offset 2 by 2 by 90°.

The invention of course extends to cover any brush obtained from the brush described above, by means, for example, of a subsequent stage involving additional rotation of the arms twisted around the axis following the example of what is known from document U.S. Pat. No. 5,551,456, and/or curving the core, following the example of what is known from document EP0832580.

The invention obviously applies to any type of brush, of any dimension, with any type of wire, and any type of bristles: normal, mixed or with special profiles. The brush according to the invention can also be used to manufacture a composite brush of the type described in EP 1 475 013 comprising an applicator element and a combing element.

Advantages

The brush according to the invention is easy, quick and inexpensive to manufacture owing to the fact that, starting out from a standard type brush, it requires only one crushing stage that is simple to carry out. The product loading capacity is considerably increased as compared to a standard type brush.

The size of the angular portion without fibers can be easily changed during the manufacturing process by simply modifying the height of the calibration gauges.

There is no ablation of fibers in the brush according to the invention, unlike what is generally known, so that for a given initial number of fibers per turn, the combing capacity of the brush is optimized. In addition, this ablation which weakens the layout and the resistance of fibers between the twisted arms is avoided.

The invention claimed is:

1. A cosmetic product applicator comprising a brush made up of fibers trapped between two twisted arms extending in an axial direction and defining turns, the arms on two adjacent turns being in contact on a portion of a turn and the fibers being driven out on either side of this portion of the turn.

2. The applicator according to claim 1, wherein the turns describe a noncircular ellipse.

3. The applicator according to claim 2, wherein the noncircular ellipse has a ratio of large axis to small axis greater than 1.1.

4. The applicator according to claim 3, wherein the ratio of large axis to small axis ranges between 1.3 and 1.6.

5. The applicator according to claim 1, wherein the turns are formed by crushing circular turns.

6. The applicator according to claim 4, wherein the turns are formed by crushing circular turns.

7. A device for conditioning and applying a product designed to be applied to the lashes or the eyebrows, comprising a container containing the product to be applied and an applicator according to claim 1.

8. A brush manufacturing process comprising the steps of:

taking a brush comprising bristles trapped between two twisted arms extending in an axial direction; and applying a radial pressure to said twisted arms so that the arms on two adjacent turns are brought in contact on a portion of a turn thus driving out the fibers on either side of this portion of the turn.

9. The manufacturing process according to claim 8, wherein said radial pressure is applied by tightening said twisted arms between n jaws of a press, n ranging between 2 and 6.

10. The manufacturing process according to claim 9, wherein the jaws are stopped at the end of their travel by a calibration gauge.

11. The manufacturing process according to claim 8, further comprising a step of performing a rotation of said twisted arms after application of said radial pressure.

12. The manufacturing process according to claim 8, further comprising a step of curving said twisted arms after application of said radial pressure.

13. A brush manufacturing process comprising the steps of:

taking a brush comprising bristles trapped between two twisted arms extending in an axial direction; and applying a radial pressure to said twisted arms so that the arms define turns, wherein radial cross-sections of the arms describe noncircular turns; and further comprising a step of performing a rotation of said twisted arms after application of said radial pressure.

* * * * *